US005775745A

United States Patent [19]

Hoppe et al.

[11] Patent Number: 5,775,745

[45] Date of Patent: Jul. 7, 1998

[54] LATCH AND LOCKSET SYSTEM

[75] Inventors: Friedrich Hoppe, Müstair, Switzerland; Heinz-Eckhard Engel, Glurns, Italy

[73] Assignee: Hoppe Holding AG, Müstair, Switzerland

[21] Appl. No.: 178,297

[22] PCT Filed: Jun. 2, 1993

[86] PCT No.: PCT/EP93/01387

§ 371 Date: Jan. 10, 1994

§ 102(e) Date: Jan. 10, 1994

[87] PCT Pub. No.: WO93/25788

PCT Pub. Date: Dec. 23, 1993

[30] Foreign Application Priority Data

| | | | |
|---|---|---|---|
| Jun. 9, 1992 | [EP] | European Pat. Off. | 92109679 |
| Jan. 16, 1993 | [DE] | Germany | 9300546 U |

[51] Int. Cl.[6] ..... E05G 1/06

[52] U.S. Cl. ..... 292/138; 292/165; 292/DIG. 53; 70/467

[58] Field of Search ..... 292/138, 165, 292/169, 169.13, 169.14, 169.17, 337, 356, 359, DIG. 51, DIG. 53; 70/467, 470, 471, 478, 479, 483, 489

[56] References Cited

U.S. PATENT DOCUMENTS

| | | | |
|---|---|---|---|
| 2,668,072 | 2/1954 | Falk | 292/165 |
| 2,959,439 | 11/1960 | Russell | 292/337 |
| 2,988,389 | 6/1961 | Wilson | 292/165 |
| 3,035,432 | 5/1962 | De Vines | 292/169 |
| 3,343,860 | 9/1967 | Köhler | 292/337 |
| 3,805,451 | 4/1974 | Miller | 292/138 |
| 3,859,827 | 1/1975 | Garcia | 292/DIG. 53 |
| 4,594,864 | 6/1986 | Hart | 70/489 |
| 5,020,343 | 6/1991 | Hart | 70/478 |
| 5,141,269 | 8/1992 | Hag | 292/169 |
| 5,177,987 | 1/1993 | Shen | 70/479 |

FOREIGN PATENT DOCUMENTS

| | | | |
|---|---|---|---|
| 583964 | 9/1933 | Germany . | |
| 302524 | 12/1928 | United Kingdom . | |
| 885342 | 12/1961 | United Kingdom | 292/356 |

*Primary Examiner*—Steven N. Meyers
*Assistant Examiner*—Gary Estremsky
*Attorney, Agent, or Firm*—Lowe, Price, LeBlanc & Becker

[57] ABSTRACT

A latch and lockset system comprises a common unit having a socket (30) that houses a rotor (40) pivotably supporting a catch (50) on a pin (53) and attached to latch means (handles 20, 22). As the lockset (10) is assembled, its components (50, 53, 40, 33/34, 23) secure themselves successively. The unit is mounted in a transversal bore (Q) of a door leaf (T) by introducing a handle (20) sideways so as to point outwardly towards the free door edge whereby the common unit becomes seated in the transversal bore (Q); then the handle main portion (24) is pivoted by 180° to reach its idle position in which the handle (20) is biased by a returning spring block (34) on the rotor (40). A guide bush (18) radially screwed into the socket (30) for securing it in a longitudinal bore (L) receives a spring-biased bolt (15). The catch (50) is an elbow lever reaching over a slanted ridge (45) between cheeks (48) of the rotor (40); a fork 52 is lockable to the inner bolt end (17), whereas a follower arm (54) engages a receiving hollow (46) of ridge (45).

28 Claims, 6 Drawing Sheets

Figure 3:
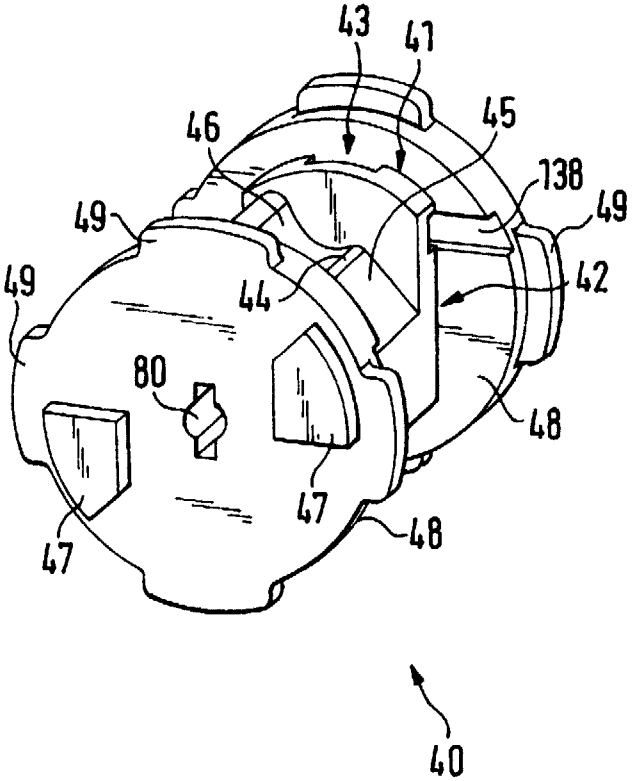

FIG. 4a
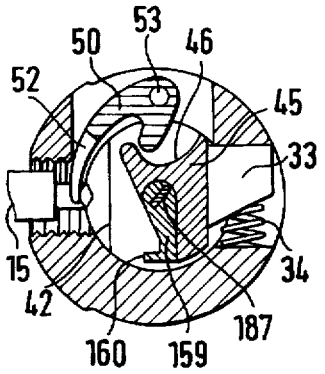
FIG. 4b
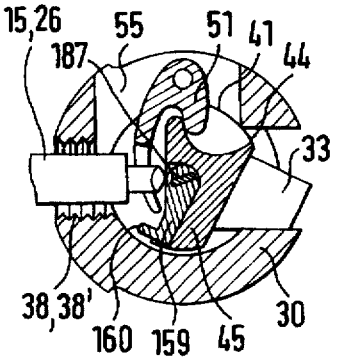
FIG. 4c
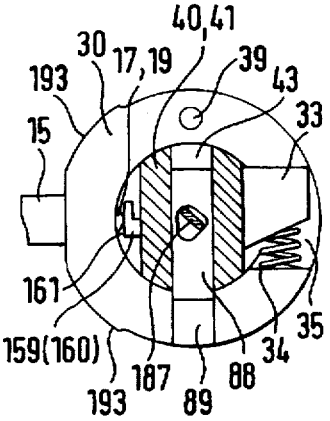
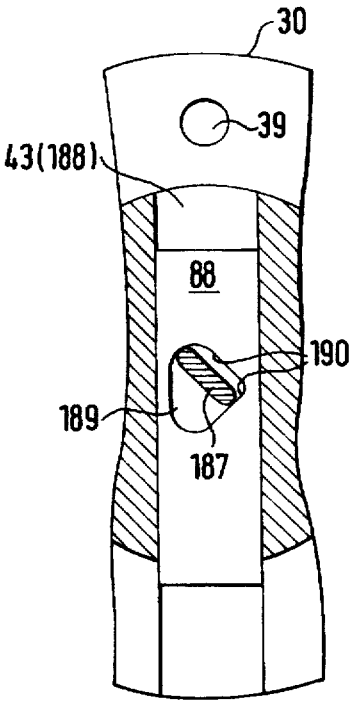
FIG. 4d
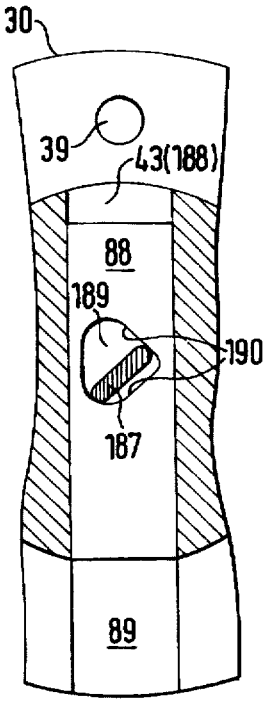
FIG. 4e
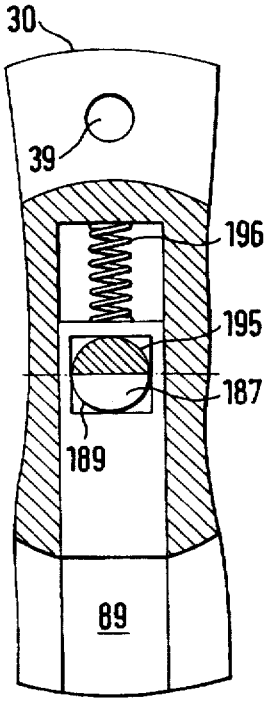
FIG. 4f

R
Q
58
74
57
T
10
35
36
55
39
51
30
18
56

LATCH AND LOCKSET SYSTEM

The invention relates to a latch and lockset system according to the generic portion of claim 1. It is used for locking and unlocking flat structures serving to close accessible openings such as doors, windows, etc. as desired.

Conventional devices of this kind include assemblies of locksets and latch mechanisms for mounting in recesses, pockets and bores of a door leaf or window frame. The methods and means of mounting are important since the individual components such as locks, lock plates, bolts, square bars, escutcheons, handles or knobs, etc. must one after the other be fixed e.g. to a door leaf in accurate positions and directions. Daily use and, of course, any wrong handling or violence are likely to misadjust the system so that its correct function may be jeopardized. In certain cases this may bring about a safety hazard.

A latch mechanism for retracting a spring-biased draw bolt by partial rotation of a knob coupled to a latch spindle as described in GB-C-302 524 comprises in a transverse bore a tubular socket that holds a rotatable disc for operating a crosshead-type catch screwed to the draw bolt which is supported in a guide sleeve along a longitudinal bore. The longitudinal and transverse bores intersect horizontally. The conventional socket-and-rotor system includes a plurality of elements to be mounted singly in a rather cumbersome fashion. It has one spring only which must be weak if the door should be closed softly; consequently, such a spring would be insufficient to also prop up handles as frequently used or required nowadays.

It is an important object of the invention to improve such a latch and lockset system by simple and economical means so as to broaden utilization and to open wider fields of application. The new design is to require relatively small expenditure for adaptation to either civil housing or utility buildings. More particularly, embodiments of the novel system are to be suitable for both butt-ended and rebated doors as well as glass doors, thin partitions, etc. Another object of the invention is to develop a latch and lockset system which is made up of few component parts, apt for quick mounting and reliable in long-time use. Fast assembly and sure function are to relieve the craftsmen and users alike.

In a system including latch means such as a knob, handle or handle pair for operating a lockset arranged in two bores that intersect each other horizontally in a door, the handle having a neck attached to a rotor a catch of which acts upon a spring-biased bolt that extends through a guide sleeve in a longitudinal bore and is movable along a shifting axis, the rotor being housed in a socket seated in a transversal bore, the invention provides that lockset, catch and handle(s) form a common unit adapted to be mounted as a whole. It will be realized that such a unit greatly advances the art since the effort of mounting is enormously reduced and accelerated at the same time. Furthermore, the compact design thus achieved warrants solidity and enhanced performance.

The system according to the invention is distinguished in that the lockset and latch mechanisms are combined in a sturdy assembly which does away with the previous necessity of milling a pocket into the door leaf for receiving a lock, of providing spaced transverse holes of special shapes and of then mounting the outer ironwork (knobs, handles, escutcheons, etc.) so as to fit the lock with more or less accuracy, depending upon the individual craftman's skill and exactitude. The consequence was often a malfunction such as jamming or rattling.

All in all, the standard version of the novel system comprises the common unit of two handles interconnected via a rotor in a socket, two cover rings, a spring-biased bolt and a guide sleeve for the latter. Only the two intersecting bores must be provided in the door, which is done quickly and cheaply, and in a minute the system is completely mounted merely by introducing a handle sideways to point outwardly towards the free door edge whereby the socket is seated in the transversal bore; then the handle main portion is pivoted by 180° to reach an idle position in which the handle is biased by a returning spring block on the rotor. A guide bush supporting the spring-borne bolt is radially screwed into the socket for securing it in a longitudinal bore. Snap-locking cover rings additionally fasten the unit. Its inner components successively secure themselves as they are assembled, warranting a stable unit that is usually prefabricated and delivered to the customer after testing. Also, the common unit may either be integral or be made up of a plurality of components joined in such manner that forces and torques applied onto the handle or handle pair are fully transferred to the socket and/or to the catch.

The socket may be C-shaped with a clearance for introducing the tilted rotor which has cheeks that receive guiding wings of a spring block by which upper and lower handle positions are defined. An otherwise similar 0-shaped socket consists of two peripherally closed and axially interconnected halves with bayonet threads at the handle neck inner face provided to engage, in a handle operating direction, matching bayonet lugs on rotor end faces.

The catch is preferably designed as an elbow lever one arm of which is a follower engaging a receiving hollow of a slanted ridge that connects side cheeks of the rotor, whereas the other lever arm includes a fork locked to the inner bolt end, thereby also precluding inadvertent turning of the bolt around its longitudinal axis.

A cross pin on top of the socket pivotably supports the catch or a pair of catches side by side at a distance corresponding to the spacing of two tapped holes at the socket periphery so as to fit lefthand or righthand door rebates. For straight-butt doors without a rebate, one catch and one central tapped hole will do for receiving the guide sleeve.

A pusher or an operating bar may serve to lock and unlock the bolt via intersecting cams and/or an inhibit shoe mounted in the rotor. The simple design will effectively prevent any inadmissible attempts to push the locked-out bolt back.

Figure 1:
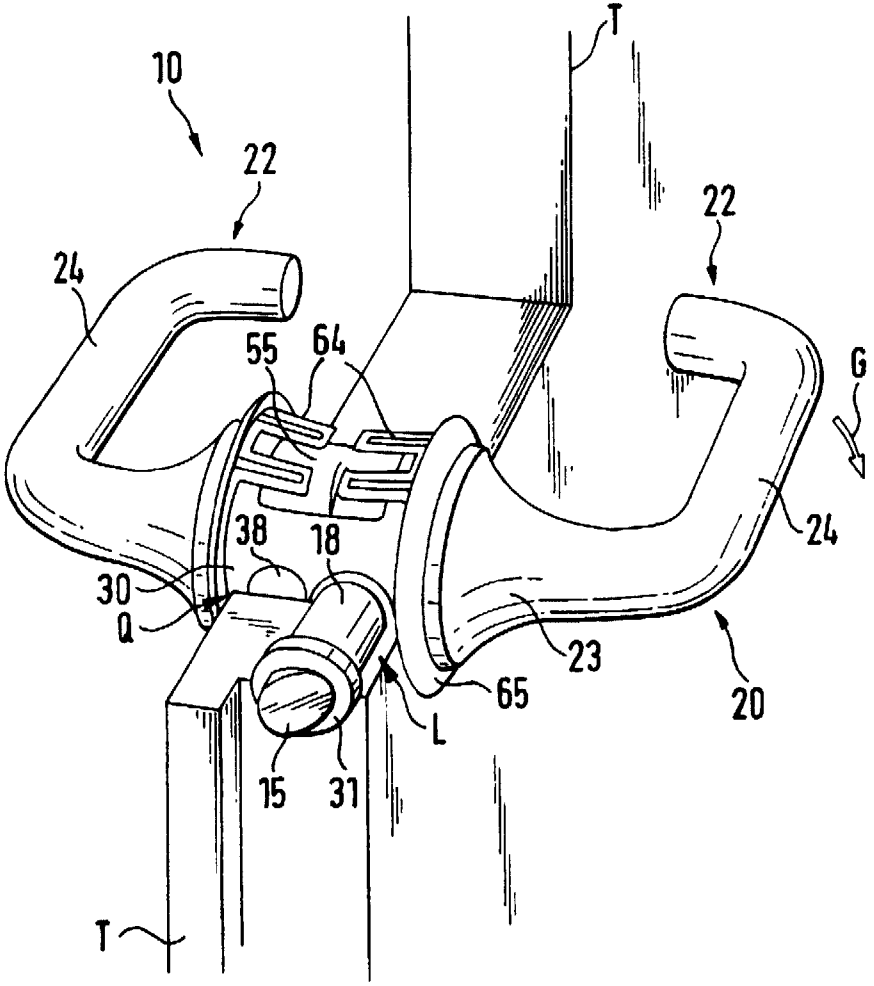
Figure 2:
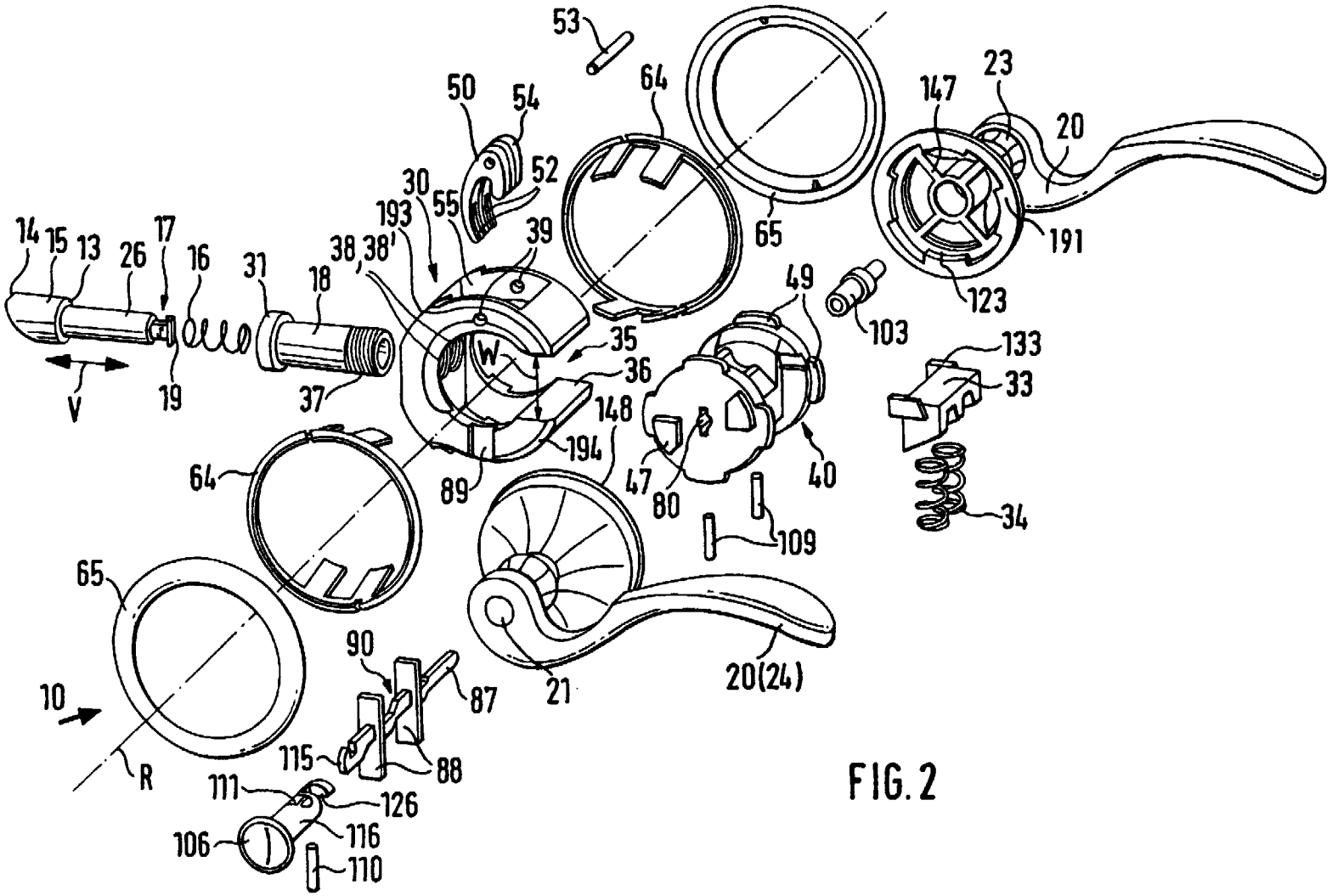
Figure 5D:
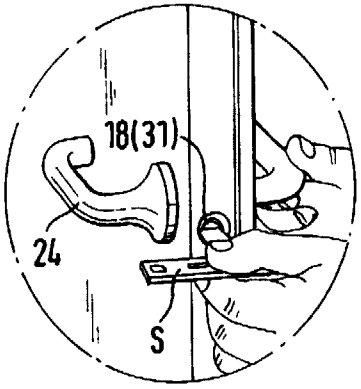
Figure 5C:
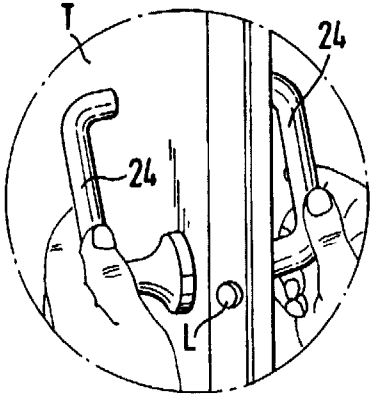
Figure 5B:
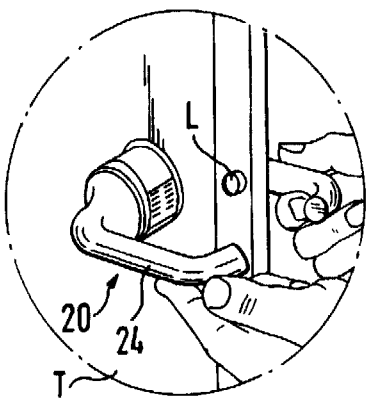
Figure 5A:
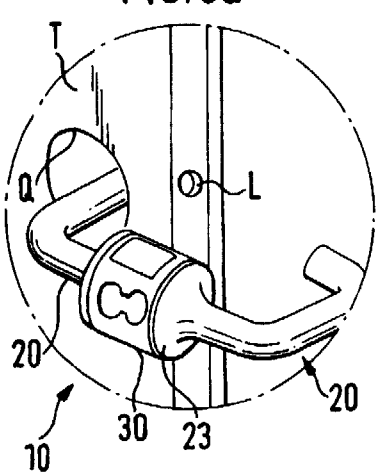
Figure 5G:
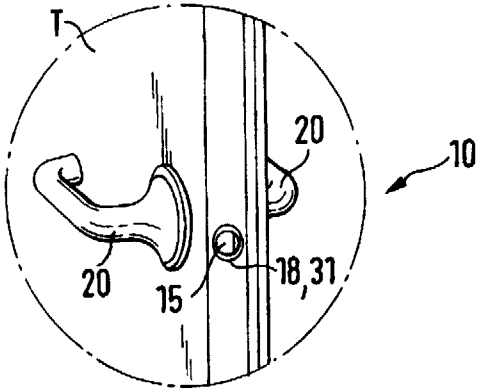
Figure 5F:
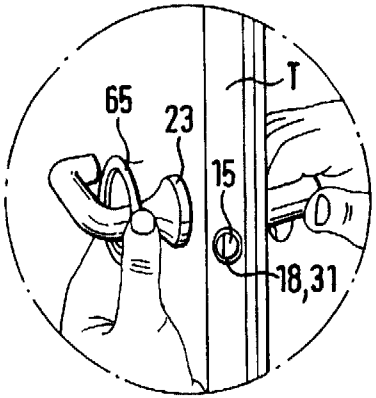
Figure 5E:
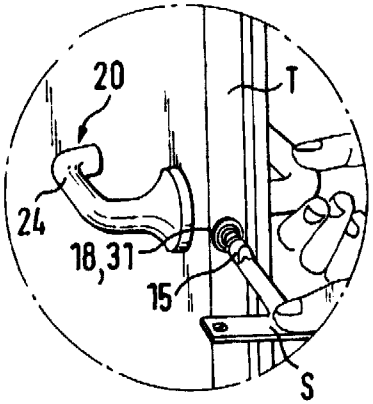
Figures 6A, 6B:
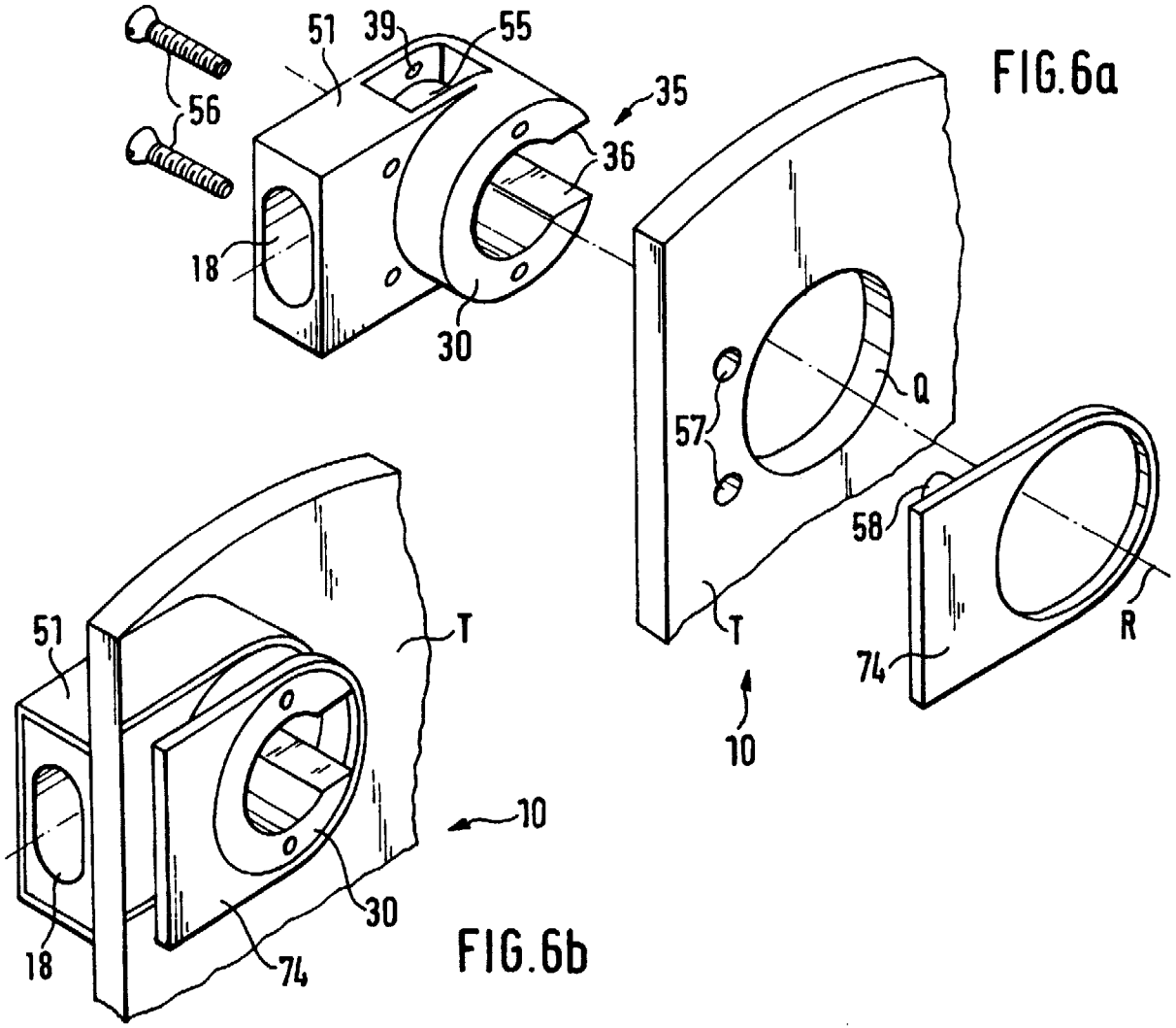
Figure 7:
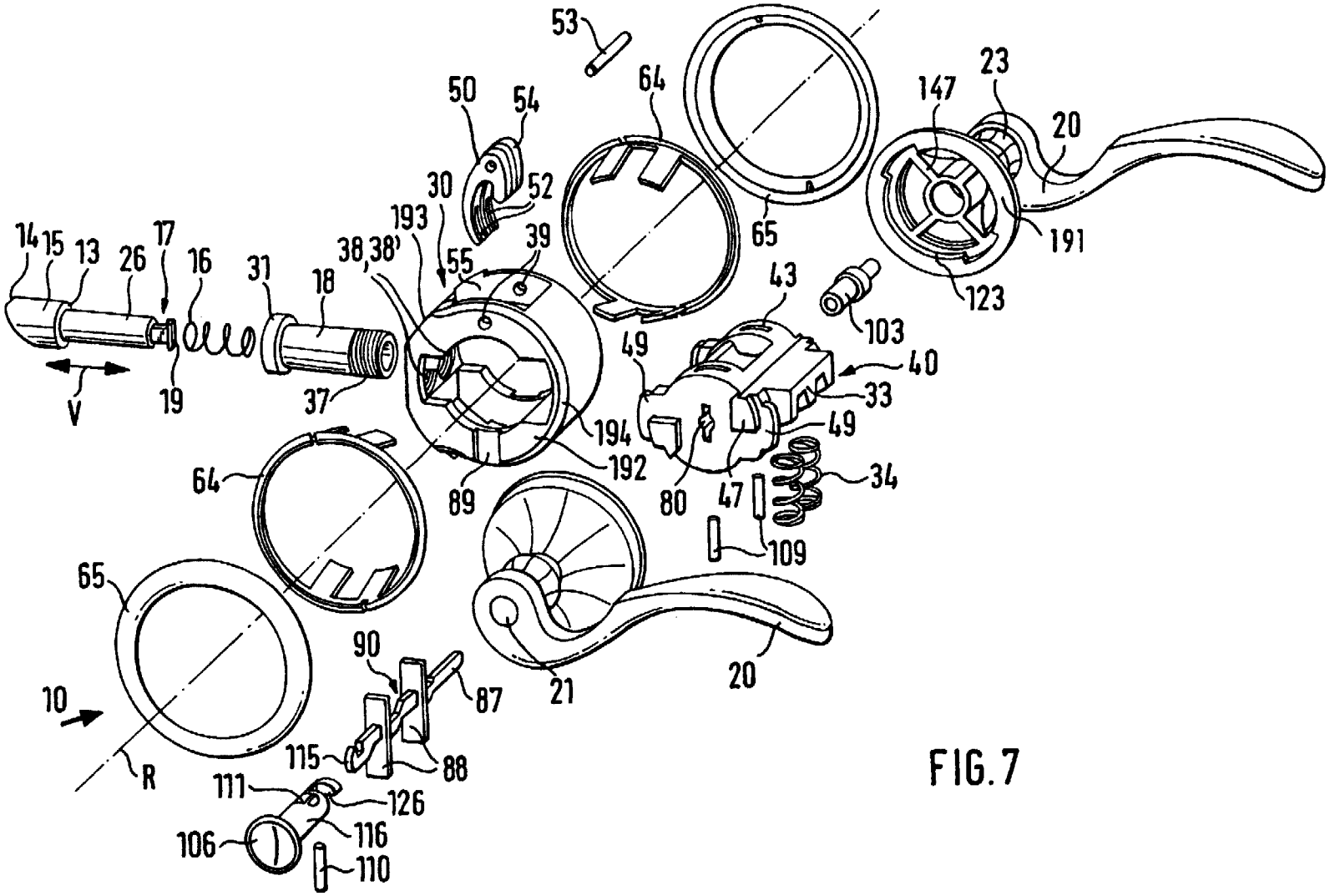

Further features, particulars and advantages of the invention will become apparent from the wording of the claims and from the following description of preferred embodiments shown in the accompanying drawings, wherein:

FIG. 1 is a perspective cutout view of a latch and lockset system mounted to a rebated door, FIG. 2 is an exploded view of the component parts of a latch and lockset system, FIG. 3 is a perspective view of a rotor, FIGS. 4*a* and 4*b* are vertical sectional views of different of catch and inhibit shoe positions in a socket, FIGS. 4*c* to 4*f* are vertical sectional views of different inhibit positions in other mechanisms, FIGS. 5*a* to 5*g* are perspective views of different stages of mounting a latch and lockset system to a rebated door, FIGS. 6*a* and 6*b* show an exploded and an assembled view, respectively, of another system mounted to a glass door, and FIG. 7 is an exploded view of the component parts of a modified latch and lockset system.

The cut-open view of FIG. 1 shows a latch and lockset 10 comprising a pair 22 of curved handles 20 having trumpet-like handle necks 23 each joining, via a clamping collar 64 and a snap-on cover ring 65, a socket 30 inserted in a transversal bore Q of a rebated door leaf T. The socket 30 includes two parallel tapped holes 38, 38' one of which receives the tapped end 37 (FIG. 2) of a guide sleeve 18 fitted in a longitudinal bore L for supporting a shiftable bolt 15. The latter is outwardly spring-biased and has a vertical outer edge 14 designed to pass an opposite cuff plate of a door frame (not shown). The handle operating direction G is indicated by an arrow.

The structural components of the latch and lockset 10 are seen in FIG. 2. Bolt 15 which can be moved along a shifting axis V has a shoulder 13 engaged by a compression spring 16 that surrounds shaft 26 of bolt 15. Its inner end 17 carries projections 19 for locking to a catch 50 discussed below. Spring 16 bears on an inside flange (not shown) in guide sleeve 18 that has an outer tapped end 37 for screwing into one of the tapped holes 38, 38' of socket 30 (FIG. 1). A collar 31 of guide sleeve 18 fits into a corresponding pocket hole (not shown) so as to be flush with the door edge.

Socket 30 seated in transversal bore Q includes projecting socket arcs 193 at either side for clip-on collars 64 topped by cover rings 65 exactly centered on bevels 194 of socket face ends 192. Handle neck 23 terminates in a sealing lip 148 acting, in combination with ring 65, as an appearance cover. Generally speaking, socket 30 is a short tubular body that may be C-shaped with a lateral opening 35 (FIG. 2) or may be O-shaped, i.e. peripherally closed (FIG. 7). Perpendicular to a rotor axis R is an inner well 55 beside which there are upper bores 39 parallel to said rotor axis R for receiving a pin 53. Catch 50 is an elbow lever pivotably supported by pin 53 and includes a fork 52 as well as a follower arm 54.

A slanted ridge 45 of a rotor 40 (FIG. 3) extends between two opposite heads 41, viz. at an angle to two flats 42 that are parallel to a transverse port 43 each in front of a side cheek 48 forming the outer portion of rotor 40 at either end. Ridge 45 includes a shoulder 44 and a receiving hollow 46 engaged by the follower arm 54 of catch 50 whose fork 52 reaches over ridge 45 to grasp the projections 19 of bolt 15 (FIGS. 4*a*, 4*b*). In a suitably tilted position, ridge 45 will pass through the clear width w of socket opening 35 for insertion of the rotor 40 along its flats 42. A spring barrel 33 is seated on rotor 40 for holding it in place but permitting its pivoting by a given angle against the force of spring block 34 (FIGS. 4*a* to 4*c*). Two parallel guide wings 133 of barrel 33 engage matching recesses 138 in the cheeks 48 of rotor 40. The free ends of spring block 34 find foothold on the lower face of opening 35 in socket 30 whereby rotor 40 held therein is biased to a home position by the springs which also define the idle position of the handle(s) 20/22.

In front of side cheeks 48, transverse ports 43 are parallel to flats 42 guide slide plates 88 each of which is horizontally traversed by a pusher 87 (FIG. 2) or by an operating bar 187 (FIGS. 4*a* to 4*f*) of suitable shape. In rotor 40, both pusher 87 and bar 187 are movable in a through hole 80 matching either shape (see FIGS. 2, 3, 7) by shifting over a given path or by turning over a given angle, respectively. Pusher 87 has a hook 115 to be coupled to a notch 126 of a locking button 106. A transverse port 111 in shaft portion 116 receives a spiral pin 110 serving to guide pusher 106 and also to fix the handle neck 23 of inner handle 20. At the other end of pusher 87 or of operating bar 187, there is an indicator pin 103 signalling, at the outer handle 20, whether the device is locked or released (free). In an emergency, indicator pin 103 could be pushed in from outside for unlocking the device which is used, in particular, for bathroom and toilet doors.

Each handle neck 23 includes bayonet threads 123 onto which matching bayonet lugs 47 at the outer faces of cheeks 48 can be screwed. Additionally, rotation stops 49 may be provided that cooperate with inner counterstops 149 of each handle neck 23, tending to fasten the connection in operating direction G (FIG. 1).

For mounting the system, catch 50 is introduced into well 55 of socket 30 and is rotatably supported there by pin 53 inserted in bores 39. Rotor 40 is laterally shoved into socket 30 through opening 35 while flats 42 are parallel to limits 36 and is turned up. Next, spring barrel 33 and spring block 34 are mounted by sliding the guide wings 133 into the recesses 138 of cheeks 48 so as to secure rotor 40 in its upright position. By bayonet locking 49/123, handle necks 23 are attached to rotor 40 and bonded thereto and/or locked by spiral pin 110, indicator pin 103 being in the outer handle 20 whereas locking button 106 in the inner handle 20 is connected via elements 126/115 to pusher 87. The latter is now in form-fit relation with slide plates 88 which are vertically movable in transverse ports 43 or 188 (FIGS. 4*c* to 4*e*), respectively.

The common unit thus assembled out of intersecured components is then inserted into transversal bore Q of door leaf T by feeding a handle 20 sideways (FIG. 5*a*) to point outwardly towards the free door edge (FIG. 5*b*). When the socket 30 is seated in bore Q, the main portion 24 of handle 20 is tilted back by 180° (FIG. 5*c*) until the proper tapped hole 38 (or 38') is aligned with longitudinal bore L so that guide sleeve 18 can be screwed in, preferably with the aid of a tool S (FIG. 5*d*). Bolt 15 is pushed into guide sleeve 18 and is turned by 90° (FIG. 5*e*), which would also be facilitated by tool S, so that projections 19 lock with fork 52 and outer edge 14 is upright. On either side of door leaf T, collar 64 and cover ring 65 are snap-mounted (FIG. 5*f*).

It will be noted that by operating locking button 106, pusher 87 supported in through hole 80 will cause locking or unlocking, respectively, of lockset 10 via cam 90. If indicator pin 103 at outer handle 20 is replaced by a cylinder lock (not shown), turning a key (not shown, either) will cause pusher 87 to retract whereby unlocking is achieved.

Retention means for bolt 15 in its outer locking position are seen in FIGS. 4*a* to 4*c*. Operating bar 187 can be introduced into an inhibit shoe 159 that is pivotable around rotor axis R. As shoe 159 is turned clockwise, its foot portion 160 will go up to engage inner end 17/19 of bolt 15 which is thus blocked against inward movement. Another feature is that rotor 40 gets locked in socket 30 by slide plates 88 (FIGS. 4*c* and 4*d*) which include an aperture 189 with ramp stops 190 so that turning the bar 187 will cause the guided slide plate 88 to lower (FIG. 4*d*) or to rise (FIG. 4*e*) along recesses 89 of socket 30.

An alternative design for operating slide plates 88 by bar 187 is shown, in FIG. 4*f* where a permanently spring-biased slide plate is lifted or lowered, respectively, by turning—with handling means such as knobs, cylinders, etc. (not shown)—a half-round shaft 195 against spring 196 or under its force.

Locksets according to the invention may also be adapted for mounting to very thin doors T, e.g. glass doors. As will be apparent from FIGS. 6*a* and 6*b*, socket 30 is inserted into transversal bore Q but since the door leaf offers too little volume or width for a longitudinal bore, socket 30 is integral with a box 51 supporting bolt 15 at one side of door T. A cover plate 74 holds box 51 from the other side, screw bolts 56 passing through holes 57 to enter nuts 58. In other respects the system is the same as described above.

Under excessive load, a C-shaped socket 30 might bend out so that opening 35 becomes wider. A closed or O-type socket 30 as shown in FIG. 7 will retain its form and dimensions, but rotor 40 must now be mounted along axis R. For this purpose, two opposite rotation stops 49 of rotor 40 extend horizontally and fit a pair of corresponding recesses in socket 30. While most other elements are identical or similar to those described above, spring barrel 33 and rotor 40 are preferably integral in this embodiment. Also, handle face ends 191 engage socket face ends 192 so as to secure pin 53 in bores 39. The curved outer or back surface of socket 30 may be used to clamp or bolt it against the interior wall of transversal bore Q, ensuring very strong fixation.

The invention is not restricted to the embodiments shown and elucidated. Summarizing, however, it will be clear that in a preferred latch and lockset system, a common mounting unit is made up of a socket 30 that houses a rotor 40 attached to latch means such as handles 20, 22 and pivotably supporting a catch 50 on a pin 53. As the lockset 10 is assembled, its components 50, 53, 40, 33/34, 23 secure themselves successively. The unit is mounted in a transversal bore Q of a door leaf T by introducing a handle 20 sideways to point outwardly towards the free door edge whereby socket 30 is seated in the transversal bore Q; then the handle main portion 24 is pivoted by 180° to reach an idle position in which handle 20 is biased by a returning spring block 34 on rotor 40. A guide bush 18 is radially screwed into socket 30 for securing it in a longitudinal bore L and receives a spring-biased bolt 15. Snap-locking cover rings 65 fasten the common unit additionally. The catch 50 is an elbow lever having a fork 52 to which the inner end 17 of bolt 15 is lockable and having a follower arm 54 engaging a slanted ridge 45 between cheeks 48 of rotor 40. Operating means 106; 187 serve to lock or unlock the bolt 15 via cams 88, 90; 190 and/or an inhibit shoe 159.

All and any features and advantages of the invention, inclusive of design details, of spatial arrangements and of procedural steps, as evident form the claims, from the specification and from the drawings may be inventively substantial both per se and in most variegated combinations.

We claim:

1. A latch and lockset adapted to operate in two bores (L, Q) that intersect each other horizontally in a door, the latch and lockset including at least one handle (20), the handle (20) having a neck (23) attached to a rotor (40) a catch (50) of which acts upon a spring-biased bolt (15) that extends through a guide element therefor, the bolt adapted to be in a longitudinal bore (L) and being movable along a shifting axis (V), the rotor (40) being housed in a socket (30) adapted to be seated in a transversal bore (Q), wherein lockset (10), catch (50) and handle (20) form a common unit preassembled for mounting by insertion in the transversal bore (Q), the bolt (15) being configured for insertion through the guide element to lock in the catch (50), wherein the catch (50) is journalled on a pin (53) arranged in a bore (39) of the socket (30) and wherein the pin (53) is axially secured by cheeks (48) of the rotor, said cheeks located at each side of the rotor (40) whose rotational axis (R) is parallel to the bore (39) of the socket.

2. System according to claim 1, wherein the rotor (40) forms a hub including two parallel flat heads (41) connected by a ridge (45) that is oblique to the bolt shifting axis (V).

3. System according to claim 2, wherein the components (50, 53, 40, 33/34, 23) of the common unit are designed to successively secure their positions as they are assembled.

4. System according to claim 1, wherein the catch (50) is an elbow lever having a first arm designed as a follower (54) for engaging a receiving hollow (46) of a ridge (45) and having a second arm with coupling means (52) for coupling the bolt (15) thereto, in particular by means of locking projections (19) at its inner end (17).

5. System according to claim 4, wherein said coupling means comprises an eye.

6. System according to claim 1, further comprising an inhibit shoe (159) opposite to the catch (50), said inhibit shoe (159) being pivotable around the rotor axis (R) by an operating bar (187) introduced into said shoe (159) for locking and unlocking the bolt (15).

7. System according to claim 6, wherein at least one guide cheek (188) associated to the inhibit shoe (159) is vertically guided at the socket (30) and has an aperture (189) with ramp-type stops (190) whereby simultaneous locking or unlocking is achieved of the bolt (15) by the inhibit shoe ( 159) and of the rotor (40) by the guide cheeks (188).

8. System according to claim 1, wherein the rotor (40) and the handle neck (23) have a common axial through hole (80) for receiving a locking mechanism that is movable within limits for respectively locking and unlocking an inhibit shoe.

9. System according to claim 1, wherein the guide element is formed as a one-piece unit with a box (51) and the socket (30), wherein said one-piece unit is adapted to be laterally attached to the door leaf (T) by an opposite cover plate (74).

10. System according to claim 1, wherein the peripheral portion of the socket (30) opposite to the bolt (15) is adapted to be secured in the transversal bore (Q) by additional fixing means.

11. System according to claim 1, wherein the common unit is made up of a plurality of individual components (50, 53, 40, 33/34, 23) interconnected in such manner that forces and torques applied onto the handle (20) or handle pair (22) are transferred to the socket (30).

12. System according to claim 1, further comprising means for engaging said bolt to said preassembled common unit when inserted in the transverse bore.

13. System according to claim 1, further comprising means for engaging said bolt through said longitudinal bore to said preassembled common unit when inserted in the transverse bore.

14. System according to claim 1, further comprising means for engaging said guide element to said socket in said preassembled common unit.

15. System according to claim 1, wherein said socket comprises stopping means for stopping rotation of said rotor and support means for supporting handle return springs when said socket is radially mounted in said transversal bore.

16. System according to claim 1, wherein said bolt (15) comprises an engaging structure at an end thereof for application of a tool thereto for locking the bolt to said catch.

17. System according to claim 1, wherein the rotor (40) and the handle neck (23) have a common axial through hole (80) for receiving an operating bar (187) that is movable within limits for locking and unlocking, respectively.

18. System according to claim 1, further comprising a longitudinally positioned spring biasing said bolt for longitudinal movement in said guide element.

19. A latch and lockset adapted to operate in two bores (L, Q) that intersect each other horizontally in a door, the latch and lockset including at least one handle (20), the handle (20) having a neck (23) attached to a rotor (40) a catch (50) of which acts upon a spring-biased bolt (15) that extends through a guide element therefor, the bolt adapted to be in a longitudinal bore (L) and being movable along a shifting axis (V), the rotor (40) being housed in a socket (30) adapted to be seated in a transversal bore (Q), wherein lockset (10), catch (50) and handle (20) form a common unit preassembled for mounting by insertion in the transversal bore (Q), the bolt (15) being configured for insertion through the guide element to lock in the catch (50), wherein said socket comprises stopping means for stopping rotation of said rotor and support means for supporting handle return springs when said socket is radially mounted in said transversal bore, further comprising a spring block (34), including a spring barrel (33), inserted in a lateral opening (35) of the socket (30) for pivotably securing the rotor (40) therein, pivot end positions of the rotor (40) defining an upper and a lower position of the handle (20).

20. System according to claim 19, wherein the socket (30) includes two peripherally closed halves (193) inserted in the transversal bore (Q) and wherein the rotor (40) is axially secured in the socket (30) by bayonet-type attachment of the handle (20) or handle pair (22) whose face ends (191) engage the socket face ends (192), thereby simultaneously securing the pin (53).

21. A latch and lockset adapted to operate in two bores (L, Q) that intersect each other horizontally in a door, the latch and lockset including at least one handle (20), the handle (20) having a neck (23) attached to a rotor (40) a catch (50) of which acts upon a spring-biased bolt (15) that extends through a guide element therefor, the bolt adapted to be in a longitudinal bore (L) and being movable along a shifting axis (V), the rotor (40) being housed in a socket (30) adapted to be seated in a transversal bore (Q), wherein lockset (10), catch (50) and handle (20) form a common unit preassembled for mounting by insertion in the transversal bore (Q), the bolt (15) being configured for insertion through the guide element to lock in the catch (50), wherein said guide element comprises a guide sleeve (18) and the handle neck (23) comprises interior bayonet threads (123) adapted to mount to bayonet lugs (47) on rotor end faces (147) in a handle operating direction (G).

22. System according to claim 21, wherein the socket (30) includes at least one tapped hole (38) for screw-fastening the guide sleeve (18) thereby fixing a radial position of the socket (30).

23. System according to claim 22, wherein a pin (53) in socket (30) forms a journal for the catch (50).

24. System according to claim 21, wherein the socket (30) includes two tapped holes (38, 38') for screw-fastening the guide sleeve (18) by which the socket (30) is radially fixed, the two tapped holes (38, 38') spaced at a distance governed by the thickness of the door (T).

25. System according to claim 24, wherein a pin (53) in socket (30) forms a journal for two catches arranged beside each other at a spacing corresponding to that of the tapped hole axes.

26. A latch and lockset adapted to operate in two bores (L, Q) that intersect each other horizontally in a door, the latch and lockset including at least one handle (20), the handle (20) having a neck (23) attached to a rotor (40) a catch (50) of which acts upon a spring-biased bolt (15) that extends through a guide element therefor, the bolt adapted to be in a longitudinal bore (L) and being movable along a shifting axis (V), the rotor (40) being housed in a socket (30) adapted to be seated in a transversal bore (Q), wherein lockset (10), catch (50) and handle (20) form a common unit preassembled for mounting by insertion in the transversal bore (Q), the bolt (15) being configured for insertion through the guide element to lock in the catch (50), wherein the socket (30) is generally C-shaped and includes a lateral opening (35) opposite to the bolt (15), said lateral opening (35) having parallel limits (36) spaced apart by a clearance having a width (W) permitting the rotor (40) to be inserted into said socket and removed from said socket, whereas by pivoting the rotor (40), in particular by 90°, it is secured and released, respectively.

27. A latch and lockset adapted to operate in two bores (L, Q) that intersect each other horizontally in a door, the latch and lockset including at least one handle (20), the handle (20) having a neck (23) attached to a rotor (40) a catch (50) of which acts upon a spring-biased bolt (15) that extends through a guide element therefor, the bolt adapted to be in a longitudinal bore (L) and being movable alone a shifting axis (V), the rotor (40) being housed in a socket (30) adapted to be seated in a transversal bore (Q), wherein lockset (10), catch (50) and handle (20) form a common unit preassembled for mounting by insertion in the transversal bore (Q), the bolt (15) being configured for insertion through the guide element to lock in the catch (50), wherein the rotor (40) and the handle neck (23) have a common axial through hole (80) for receiving a locking mechanism that is movable within limits for respectively locking and unlocking an inhibit shoe, wherein the locking mechanism comprises intersecting cams (90) by way of a horizontal pusher (87) in driving connection with two vertical slide plates (88) which are guided in rotor heads (41) and are adapted to engage, in a locking position, associated recesses (89) of the socket (30).

28. A latch and lockset adapted to operate in two bores (L, Q) that intersect each other horizontally in a door, the latch and lockset including at least one handle (20), the handle (20) having a neck (23) attached to a rotor (40) a catch (50) of which acts upon a spring-biased bolt (15) that extends through a guide element therefor, the bolt adapted to be in a longitudinal bore (L) and being movable along a shifting axis (V), the rotor (40) being housed in a socket (30) adapted to be seated in a transversal bore (Q), wherein lockset (10), catch (50) and handle (20) form a common unit preassembled for mounting by insertion in the transversal bore (Q), the bolt (15) being configured for insertion through the guide element to lock in the catch (50), wherein the catch (50) is an elbow lever having a first arm designed as a follower (54) for engaging a receiving hollow (46) of a ridge (45) and having a second arm with coupling means (52) for coupling the bolt (15) thereto, in particular by means of locking projections (19) at its inner end (17), wherein said coupling means comprises a fork adapted to engage projections extending from said bolt.

* * * * *